US011220932B2

(12) United States Patent
Kontomaris et al.

(10) Patent No.: US 11,220,932 B2
(45) Date of Patent: Jan. 11, 2022

(54) USE OF PERFLUOROHEPTENES IN POWER CYCLE SYSTEMS

(71) Applicant: The Chemours Company FC, LLC, Wilmington, DE (US)

(72) Inventors: Konstantinos Kontomaris, Wilmington, DE (US); Luke David Simoni, Wilmington, DE (US)

(73) Assignee: THE CHEMOURS COMPANY FC, LLC, Wilmington, DE (US)

( * ) Notice: Subject to any disclaimer, the term of this patent is extended or adjusted under 35 U.S.C. 154(b) by 0 days.

(21) Appl. No.: 16/073,675

(22) PCT Filed: Feb. 24, 2017

(86) PCT No.: PCT/US2017/019323
§ 371 (c)(1),
(2) Date: Jul. 27, 2018

(87) PCT Pub. No.: WO2017/147400
PCT Pub. Date: Aug. 31, 2017

(65) Prior Publication Data

US 2020/0131943 A1 Apr. 30, 2020

Related U.S. Application Data

(60) Provisional application No. 62/299,580, filed on Feb. 25, 2016.

(51) Int. Cl.
*F01K 25/08* (2006.01)

(52) U.S. Cl.
CPC ..... *F01K 25/08* (2013.01)

(58) Field of Classification Search
CPC ..... F01K 25/08
(Continued)

(56) References Cited

U.S. PATENT DOCUMENTS 3,584,457 A 6/1971 Davoud
4,142,108 A 2/1979 Matthews
(Continued)

FOREIGN PATENT DOCUMENTS

CN 102257334 11/2011
EP 1 983 038 10/2008
(Continued)

OTHER PUBLICATIONS

Chen et al., "A supercritical Rankine cycle using zeotropic mixture working fluids for the conversion of low-grade heat into power," Energy, 2011, 36: 549-555 and references therein.
(Continued)

*Primary Examiner* — Hoang M Nguyen

(57) ABSTRACT

A process is provided for converting heat energy from a heat source to mechanical work or electricity by utilizing a working fluid comprising perfluoroheptene. The process comprises heating a working fluid using heat supplied from the heat source; and expanding the heated working fluid to generate mechanical work. Also provided is an organic Rankine power cycle system utilizing a working fluid comprising perfluoroheptene. Further provided is a method of replacing the working fluid of an Organic Rankine Power Cycle System designed and configured to utilize a working fluid comprising HFC-245fa with a working fluid comprising of a perfluoroheptene.

4 Claims, 2 Drawing Sheets

(58) Field of Classification Search
USPC ..... 60/649, 651, 671, 673
See application file for complete search history.

(56) References Cited

U.S. PATENT DOCUMENTS

| | | | | |
|---|---|---|---|---|
| 4,926,650 | A * | 5/1990 | Dawn | C09K 5/044 252/67 |
| 5,762,817 | A * | 6/1998 | Merchant | C11D 7/5081 252/67 |
| 2006/0010872 | A1 | 1/2006 | Singh et al. | |
| 2010/0154419 | A1 | 6/2010 | Kontomaris | |
| 2016/0137895 | A1* | 5/2016 | Kontomaris | C09K 5/045 62/114 |

FOREIGN PATENT DOCUMENTS

| | | |
|---|---|---|
| GB | 1 204 119 | 9/1970 |
| WO | WO 2010/0080467 | 7/2010 |
| WO | WO 2013/028476 | 5/2014 |
| WO | WO 2015/077570 | 5/2015 |
| WO | 2015/095285 | 6/2015 |
| WO | WO 2015/0187413 | 12/2015 |

OTHER PUBLICATIONS

Davis and Michaelides, "Geothermal power production from abandoned oil wells," Energy, 2009, 34: 866-872.

International Preliminary Report on Patentability in International Application No. PCT/US2017/019323, dated Sep. 7, 2018, 8 pages.

Tahir et al., "Efficiency of compact organic Rankine cycle system with rotary-vane-type expander for low-temperature waste heat recovery", Intl J. of Mechanical and Mechatronics Eng, 2010, 4(1): 105-110.

JP Japanese Office Action in Japanese Appln. No. JP 2018-542190, dated Jan. 19, 2021, 23 pages.

CN Chinese Office Action in Chinese Appln. No. 2017-80012986.6, dated Sep. 1, 2020, 49 pages.

International Search Report and Written Opinion in international application No. PCT/US2017/019323 dated May 26, 2017, 14 pgs.

* cited by examiner

USE OF PERFLUOROHEPTENES IN POWER CYCLE SYSTEMS

CROSS-REFERENCE TO RELATED APPLICATIONS

This application is a § 371 National Stage Application of PCT/US2017/019323, filed Feb. 24, 2017 which claims the benefit of U.S. Provisional Application Ser. No. 62/299,580, filed Feb. 25, 2016, the disclosure of which is incorporated herein by reference in its entirety.

TECHNICAL FIELD OF INVENTION

The invention relates generally to Power Cycle systems; more specifically, to Organic Rankine Cycle systems; and more particularly, to the use of an organic working fluid in such systems.

BACKGROUND OF THE INVENTION

An Organic Rankine Cycle (ORC) system is named for its use of organic working fluids that enable such a system to capture heat from low temperature heat sources such as geothermal heat, biomass combustors, industrial waste heat, and the like. The captured heat maybe converted by the ORC system into mechanical work and/or electricity. Organic working fluids are selected for their liquid-vapor phase change characteristics, such as having a lower boiling temperature than water.

A typical ORC system includes an evaporator for absorbing heat to evaporate a liquid organic working fluid into a vapor, an expansion device, such as a turbine, through which the vapor expands, a condenser to condense the expanded vapor back into a liquid, and a compressor or liquid pump to cycle the liquid working fluid back through the evaporator to repeat the cycle. As the organic fluid vapor expands through the turbine, it turns the turbine which in turn rotates an output shaft. The rotating output shaft may be further connected through mechanical linkage to produce mechanical energy or turn a generator to produce electricity.

The organic working fluid undergoes the following cycle in an ORC system: near adiabatic pressure rise through the compressor, near isobaric heating through the evaporator, near adiabatic expansion in the expander, and near isobaric heat rejection in the condenser. 1,1,1,3,3-Pentafluoropropane (also known as "R245fa" or "HFC-245fa") is commonly chosen as a working fluid for use in ORC systems due to its thermodynamic properties that are suitable for use with low temperature heat sources, non-flammable characteristics, and no Ozone Depletion Potential (ODP). However, the maximum permissible working pressure of most commercially available power cycle equipment is limited to about 3 MPa, which limits the evaporating temperature of cycles operating with HFC-245fa as the working fluid to below about 145° C.

There is a continual need to seek out alternative organic working fluids that are capable of capturing heat over a greater range of conditions, chemically stable, and yet environmentally friendly.

SUMMARY

Provided is a process for converting heat into mechanical work in a power cycle. The power cycle includes the steps of heating a working fluid with a heat source to a temperature sufficient to pressurize the working fluid and causing the pressurized working fluid to perform mechanical work. The working fluid may include a perfluoroheptene selected from the group consisting of 2-perfluoroheptene, 3-perfluoroheptene, and combinations thereof. The process may utilize a sub-critical power cycle, trans-critical power cycle, or a super-critical power cycle.

Further provided is a process for converting heat to mechanical work in a Rankine cycle. The Rankine cycle includes the steps of vaporizing a liquid working fluid with a low temperature heat source, expanding the resulting vapor through an expansion device to generate mechanical work, cooling the resulting expanded vapor to condense the vapor into a liquid, and pumping the liquid working fluid to the heat source to repeat the process. The working fluid may include a perfluoroheptene selected from the group consisting of 2-perfluoroheptene, 3-perfluoroheptene, and combinations thereof.

Still further provided is an organic Rankine cycle system having a primary loop configured to utilize a working fluid comprising HFC-245fa to convert heat to mechanical work. The primary loop may be charged with a working fluid having a perfluoroheptene selected from the group consisting of 2-perfluoroheptene, 3-perfluoroheptene, and combinations thereof. The organic Rankine cycle system may also include a secondary heat exchange loop configured to transfer heat from a remote heat source to the primary loop. The secondary heat exchange loop may also be charged with a working fluid having a perfluoroheptene.

Still further provided is a method to replace the working fluid of an Organic Rankine Cycle System charged with HFC-245fa. The method includes the steps of evacuating the working fluid comprising HFC-245fa from the ORC system, optionally flushing the ORC system with a working fluid comprising a perfluoroheptene, and charging the ORC system with a working fluid having a perfluoroheptene selected from the group consisting of 2-perfluoroheptene, 3-perfluoroheptene, and combinations thereof.

Perfluoroheptenes such as 2-perfluoroheptene, 3-perfluoroheptene, and mixtures thereof have higher critical temperatures, lower vapor pressures, and expected to have lower GWPs when compared to HFC-245fa. Working fluids containing perfluoroheptenes may be used as direct replacements for HFC-245fa in existing ORC systems. It is projected that by replacing a working fluid comprising HFC-245fa with a working fluid comprising a mixture of 2-perfluoroheptene and 3-perfluoroheptene, the cycle efficiency of the ORC system may be increased (e.g. by 1.8%) while lowering the operating pressure of the evaporator heat exchanger to levels well below the maximum design pressures of most common commercial equipment components (e.g. heat exchangers) and reducing the working fluid GWP by more than 99.5%.

Further features and advantages of the invention will appear more clearly on a reading of the following detailed description of embodiments of the invention, which is given by way of non-limiting example only and with reference to the accompanying drawings.

DETAILED DESCRIPTION

Definitions

Figure 1:
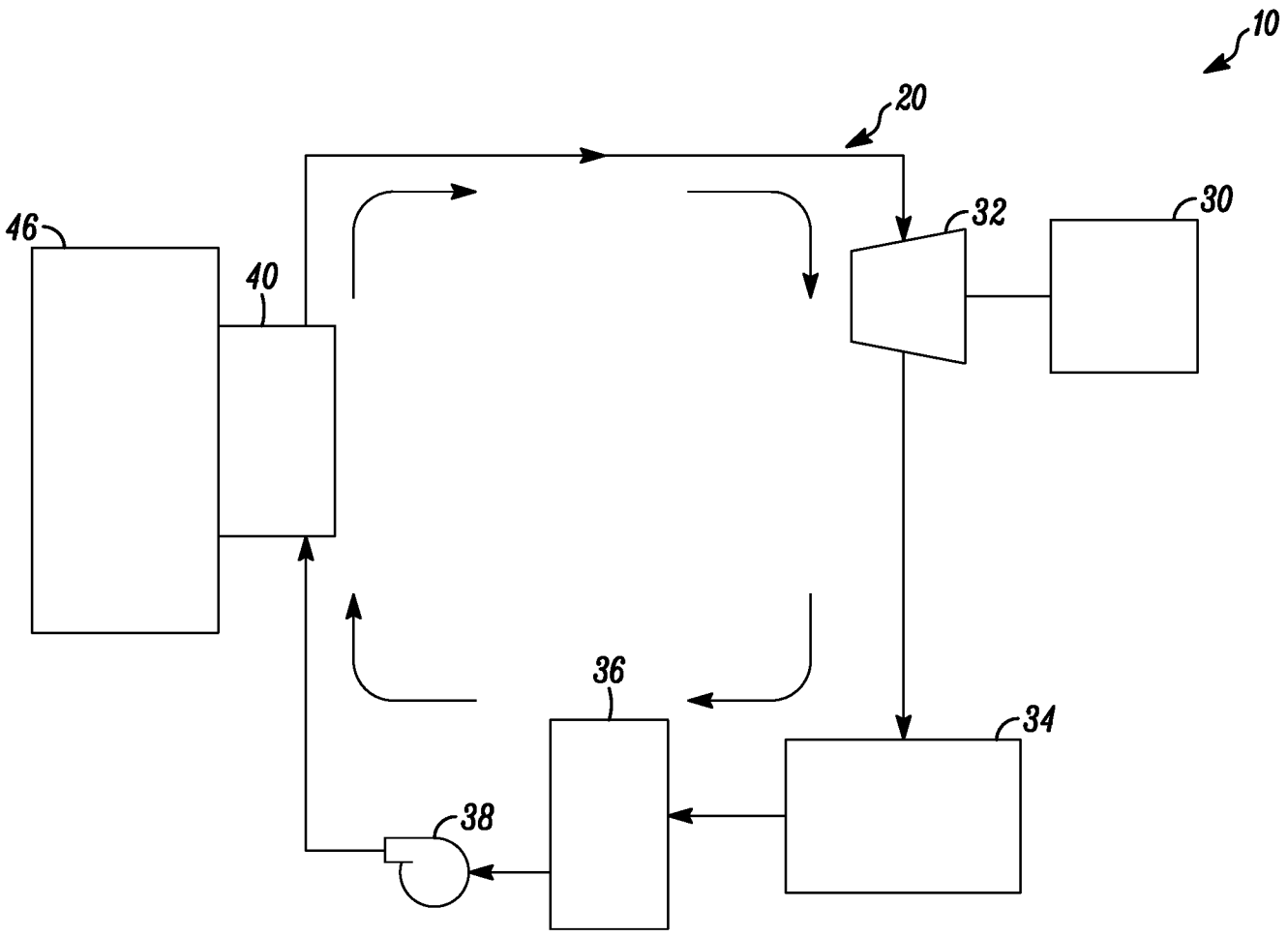
FIG. 1 is a block diagram of an exemplary organic Rankine cycle system.

Before addressing details of embodiments described below, the following terms are defined or clarified.

"a" or "an" are employed to describe elements and components described herein. This is done merely for convenience and to give a general sense of the scope of the invention. This description should be read to include one or at least one and the singular also includes the plural unless it is obvious that it is meant otherwise.

"Critical Pressure" is the pressure at or above which a fluid does not undergo a vapor-liquid phase transition no matter how much the temperature is varied.

"Critical Temperature" is the temperature at and above which a fluid does not undergo a vapor-liquid phase transition no matter how much the pressure is varied.

"Cycle Efficiency" (also referred to as thermal efficiency) is the net cycle power output divided by the rate at which heat is received by the working fluid during the heating stage of a power cycle (e.g., organic Rankine cycle).

"Global warming potential (GWP)" is an index for estimating the relative global warming contribution due to atmospheric emission of a kilogram of a particular greenhouse gas compared to emission of a kilogram of carbon dioxide. GWP can be calculated for different time horizons showing the effect of atmospheric lifetime for a given gas. The GWP for the 100 year time horizon is commonly the value referenced.

"Low-Quality Heat" means low temperature heat that has less energy density and cannot be converted to useful work efficiently. It is generally understood that a heat source with temperature below 300° C. is considered as a low-quality heat source, because heat is considered not converted efficiently below that temperature using steam Rankine cycle.

"Net Cycle Power Output" is the rate of mechanical work generation at the expander (e.g., a turbine) of an ORC less the rate of mechanical work consumed by the compressor (e.g., a liquid pump).

"Normal Boiling Point (NBP)" is the temperature at which a liquid's vapor pressure equals one atmosphere.

"Volumetric Capacity" for power generation is the net cycle power output per unit volume of working fluid (as measured at the conditions at the expander outlet) circulated through the power cycle (e.g., organic Rankine cycle).

"Sub-cooling" is the reduction of the temperature of a liquid below that liquid's saturation temperature for a given pressure. The saturation temperature is the temperature at which a vapor composition is completely condensed to a liquid (also referred to as the bubble point). Sub-cooling continues to cool the liquid to a lower temperature liquid at the given pressure. Sub-cool amount is the amount of cooling below the saturation temperature (in degrees) or how far below its saturation temperature a liquid composition is cooled.

"Superheat" is a term that defines how far above the saturation vapor temperature of a vapor composition a vapor composition is heated. Saturation vapor temperature is the temperature at which, if a vapor composition is cooled, the first drop of liquid is formed, also referred to as the "dew point".

An ORC System having an Improved Working Fluid

Shown in FIG. 1 is an exemplary ORC system 10 for converting heat into useful mechanical power by using a working fluid comprising a perfluoroheptene. The ORC system 10 includes a closed working fluid loop 20 having a first heat exchanger 40, an expansion device 32, a second heat exchanger 34, and a pump 38 or compressor 38 to circulate the working fluid through the closed working fluid loop 20. The first heat exchanger 40 may be in direct thermal contact with a low quality heat source 46 from which the relatively low temperature heat is captured by the ORC system 10 and converted into useful mechanical work, such as rotating a shaft about its longitudinal axis. The ORC system may include an optional surge tank 36 downstream of the second heat exchanger 34 and upstream of the compressor 38 or pump 38.

Heat energy is transferred from the heat source 46 to the working fluid cycling through the first heat exchanger 40. The heated working fluid leaves the first heat exchanger 40 and enters the expansion device 32 where a portion of the energy of the expanding working fluid is converted into the mechanical work. Exemplary expansion devices 32 may include turbo or dynamic expanders, such as turbines; or positive displacement expanders, such as screw expanders, scroll expanders, piston expanders, and rotary vane expanders. The expanded and cooled working fluid leaving the expansion device enters the second heat exchanger 34 to be further cooled. The pump 38 or compressor 38 is located downstream of the second heat exchanger 34 and upstream from the first heat exchanger 40 to circulate the working fluid through the ORC system 10 to repeat the process.

The rotating shaft can be used to perform any mechanical work by employing conventional arrangements of belts, pulleys, gears, transmissions or similar devices depending on the desired speed and torque required. The rotating shaft may also be connected to an electric power-generating device 30 such as an induction generator. The electricity produced can be used locally or delivered to a grid.

Figure 2:
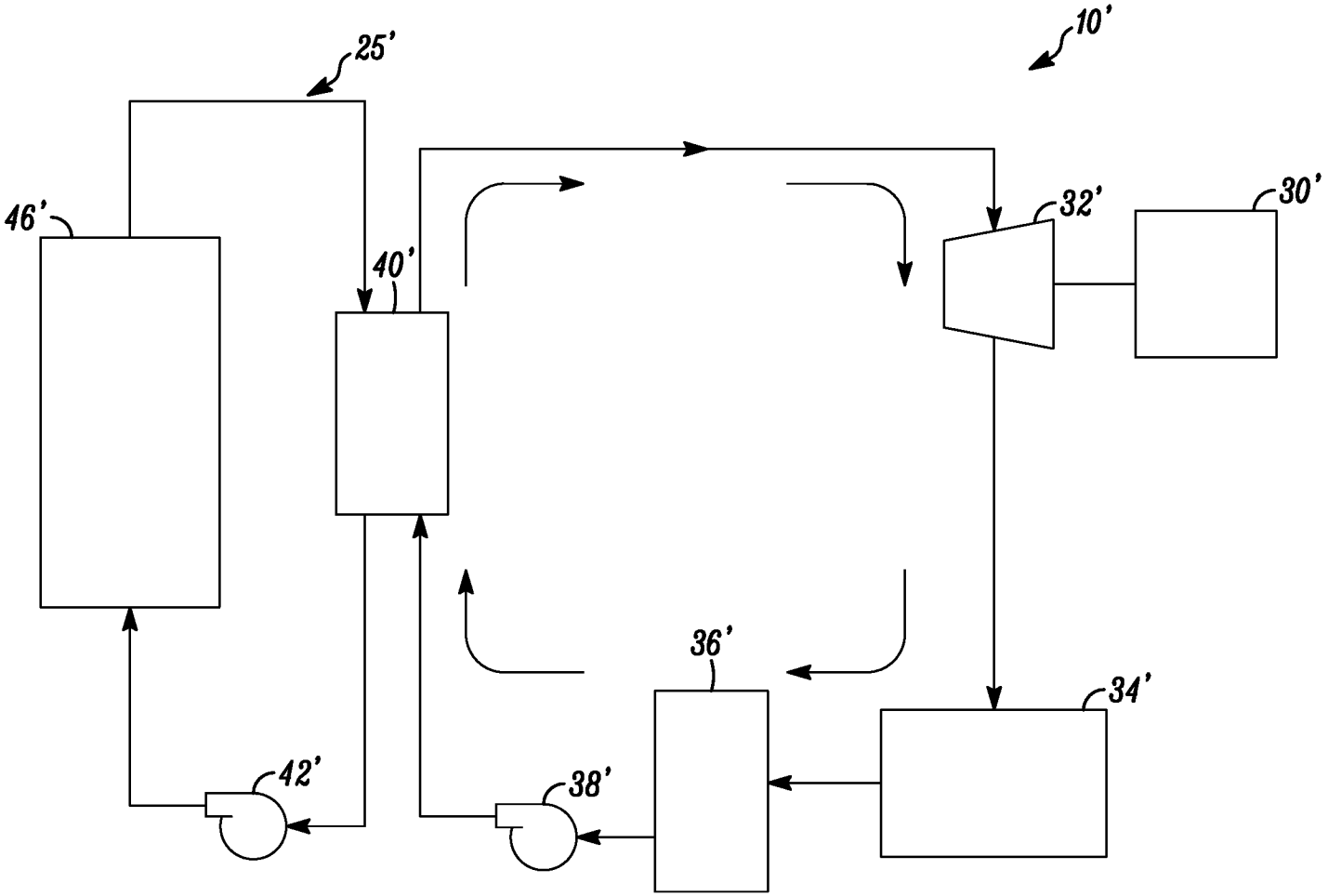
FIG. 2 is a block diagram of an exemplary organic Rankine cycle system having a secondary loop system.

Shown in FIG. 2 is an ORC system having a secondary heat exchange loop 25'. The secondary heat exchange loop 25' may be used to convey heat energy from a remote source 46' to a supply heat exchanger 40'. The heat from the remote heat source 46' is transported to the supply heat exchanger 40' using a heat transfer medium cycling through the secondary heat exchanger loop 25'. The heat transfer medium flows from the heat supply heat exchanger 40' to pump 42' that pumps the heat transfer medium back to heat source 46' to repeat the cycle. This arrangement offers another means of removing heat from a remote heat source and delivering it to the ORC system 10'. The supply heat exchanger 40' of the secondary heat exchange loop 25' may be the same as the heat exchanger 40 of the ORC system 10 of FIG. 1, however, the heat transfer medium of the secondary heat exchange loop 25' is in non-contact thermal communication with the working fluid of the ORC system 10'. In other words, heat is transferred from the heat transfer medium of the secondary loop 25' to the working fluid of the ORC system 10', but the heat transfer medium of the secondary loop does not co-mingle with the working fluid of the ORC system 10'. This arrangement provides flexibility by facilitating the use of various fluids for use in the secondary loop and the ORC system.

The working fluid containing a perfluoroheptene may also be used as a secondary heat exchange loop fluid provided the pressure in the loop is maintained at or above the fluid saturation pressure at the temperature of the working fluid in the loop. Alternatively, working fluids containing a perfluoroheptene may be used as secondary heat exchange loop fluids or heat carrier fluids to extract heat from heat sources in a mode of operation in which the working fluids are allowed to evaporate during the heat exchange system thereby generating large fluid density differences sufficient to sustain fluid flow (thermosiphon effect). Additionally, high-boiling point fluids such as glycols, brines, silicones, or other essentially non-volatile fluids may be used for sensible heat transfer in the secondary loop arrangement.

Working Fluid Comprising a Perfluoroheptene

Heat available at relatively low temperatures, as compared to the temperature of high-pressure steam driving (inorganic) power cycles, can be used to generate mechanical work through Organic Rankine power Cycles. The use of a working fluid comprising a perfluoroheptene can enable power cycles to receive heat energy through evaporation at temperatures higher than the critical temperatures of known incumbent working fluids, such as HFC-245fa, thus leading to higher cycle energy efficiencies. "HFC-245fa" is also known by its chemical name 1,1,1,3,3,-pentafluoropropane, and it is marketed under the Enovate® and Genetron® brand name by Honeywell. Perfluoroheptenes may include 2-perfluoroheptene ($CF_3CF_2CF_2CF_2CF{=}CFCF_3$) and 3-perfluoroheptene ($CF_3CF_2CF_2CF{=}CFCF_2CF_3$), and are available from Chemours Company, LLC. Perfluoroheptenes may be produced by the process for the production of fluorinated olefins as disclosed in U.S. Pat. No. 5,347,058, which is hereby incorporated by reference in its entirety.

Perfluoroheptenes have higher critical temperatures, lower vapor pressures, and expected to have lower GWPs when compared to HFC-245fa. Working fluids containing a perfluoroheptene may be used as direct replacements for HFC-245fa in existing ORC systems that are designed to utilize working fluids that contain HFC-245fa. The working fluid may contain 2-perfluoroheptene, 3-perfluoroheptene, or combinations thereof. It is projected that if a working fluid comprising HFC-245fa is replaced with a working fluid comprising a mixture of 2-perfluoroheptene and 3-perfluoroheptene, the cycle efficiency of the ORC system may be increased (e.g. by 1.8%) while lowering the operating pressure of the evaporator heat exchanger to levels well below the maximum design pressure of commonly available commercial equipment components (e.g. heat exchangers) for ORC systems and reducing the working fluid GWP by more than 99.5%.

The improved working fluid may comprise of at least one perfluoroheptene selected from the group consisting of 2-perfluoroheptene and 3-perfluoroheptene. As shown in Table 1, the critical temperature and pressure of a mixture of 2-perfluoroheptene (20%) and 3-perfluoroheptene (80%) (purity: 99.20%) are 198° C. and 1.54 MPa, respectively. The normal boiling point of the mixture is 72.5° C. The higher critical temperature of the mixture of 2-perfluoroheptene and 3-perfluoroheptene enables the working fluid to receive heat through condensation at higher temperatures approaching 198° C.

The working fluid comprising a perfluoroheptene may further comprise at least one compound selected from the group consisting of Hydrofluoroolefins (HFOs), Hydro-Chloro-Fluoro-Olefins (HCFOs), Hydro-Fluoro-Carbons (HFCs), Hydro-Fluoro-Ethers (HFEs), Hydro-Fluoro-Ether-Olefins (HFEOs), Alcohols, Ethers, Ketones and Hydrocarbons (HCs). More specifically, the working fluid comprising a perfluoroheptene may further comprise at least one component selected from the group consisting of Vertrel® Sinera™ (aka as Vertrel® HFX-110, is a mixture of Methyl Perfluoro-Heptene Ether isomers available from Chemours Co., Wilmington, Del., USA), HFO-153-10mzzy, F22E, HFO-1438mzz(E), HFO-1438mzz(Z), HFO-1438ezy(Z), HFO-1438ezy(E), HFO-1336ze(Z), HFO-1336ze(E), HFO-1336mzz(Z), HFO-1336mzz(E), HFO-1234ze(E), HFO-1234ze(Z), HFO-1234yf, HCFO-1233zd(Z), HCFO-1233zd (E), HFC-43-10mee, HFC-365mfc, HFC-236ea, HFC-245fa, HFE-7000 (also known as HFE-347mcc or n-$C_3F_7OCH_3$), HFE-7100 (also known as HFE-449mccc or $C_4F_9OCH_3$), HFE-7200 (also known as HFE-569mccc or $C_4F_9OC_2H_5$), HFE-7300 (also known as 1,1,1,2,2,3,4,5,5,5-decafluoro-3-methoxy-4-(trifluoromethyl)-pentane or $C_7H_3F_{13}O$), HFE-7500 (also known as 3-ethoxy-1,1,1,2,3,4,4,5,5,6,6,6-dodecafluoro-2-trifluoromethyl-hexane or $(CF_3)_2CFCF(OC_2H_5)CF_2CF_2CF_3$), pentanes, hexanes, methanol, ethanol, propanols, fluorinol, dimethoxymethane, dimethoxyethane, and diethoxyethane. HFE-7000, HFE-7100, HFE-7200, HFE-7300, and HFE-7400 are marketed as Novec® Engineered Fluids by 3M®.

As an alternative, the improved working fluid may consist of at one component selected from a group consisting of 2-perfluoroheptene, 3-perfluoroheptene, and a mixture of 2-perfluoroheptene and 3-perfluoroheptene. Yet, as another alternative, the working fluid composition may consist of 2-perfluoroheptene. Yet, as another alternative, the working fluid composition may consist of 3-perfluoroheptene. Yet, as another alternative, the working fluid composition may consist of a mixture of 2-perfluoroheptene and 3-perfluoroheptene.

As indicated above, the critical temperature of a mixture of 2-perfluoroheptene (20%) and 3-perfluoroheptene (80%) (purity: 99.20%) is 198° C. Therefore, a working fluid containing a perfluoroheptene enables an ORC system designed and configured for a working fluid comprising HFC-245fa to extract heat at higher evaporating temperatures and realize higher energy efficiencies than with the working fluid comprising HFC-245fa. The working fluid comprising HFC-245fa in existing ORC systems may be replaced with a working fluid containing a perfluoroheptene to increase the efficiencies of these existing systems.

Sub-Critical Cycle

In one embodiment, the present invention relates to a process of using a working fluid comprising a perfluoroheptene to convert heat to mechanical work by using a sub-critical power cycle. The ORC system is operating in a sub-critical cycle when the working fluid receives heat at a pressure lower than the critical pressure of the working fluid and the working fluid remains below its critical pressure throughout the entire cycle. This process comprises the following steps: (a) compressing a liquid working fluid to a pressure below its critical pressure; (b) heating the compressed liquid working fluid from step (a) using heat supplied by the heat source to form a vapor working fluid; (c) expanding the vapor working fluid from step (b) in an expansion device to generate mechanical work; (d) cooling the expanded working fluid from step (c) to form a cooled liquid working fluid; and (e) cycling the cooled liquid working fluid from step (d) to step (a) to repeat the cycle.

Operating in sub-critical cycles, the evaporating temperature at which the working fluid comprising a perfluoroheptene absorbs heat from the heat source is in the range of from about 100° C. to about 190° C., preferably from about 125° C. to about 185° C., more preferably from about 150° C. to 185° C. Typical expander inlet pressures for sub-critical cycles are within the range of from about 0.25 MPa to about 0.01 MPa below the critical pressure. Typical expander outlet pressures for sub-critical cycles are within the range of from about 0.01 MPa to about 0.25 MPa, more typically from about 0.04 MPa to about 0.12 MPa.

In the case of sub-critical cycle operations, most heat supplied to the working fluid is supplied during evaporation of the working fluid. As a result, when the working fluid consists of a single fluid component or when the working fluid is a near-azeotropic multicomponent fluid blend, the working fluid temperature is essentially constant during transfer of heat from the heat source to the working fluid.

Trans-Critical Rankine Cycle

In contrast with the subcritical cycle, the working fluid temperature can vary when the fluid is heated isobarically without phase change at a pressure above its critical pressure. Accordingly, when the heat source temperature varies, use of a fluid above its critical pressure to extract heat from a heat source allows better matching between the heat source temperature and the working fluid temperature compared to the case of sub-critical heat extraction. As a result, efficiency of the heat exchange system between a temperature-varying heat source and a single component or near-azeotropic working fluid in a super-critical cycle or a trans-critical cycle is often higher than that of a sub-critical cycle (see Chen, et al., Energy, 36, (2011) 549-555 and references therein).

In another embodiment, the present invention relates to a process of using a working fluid comprising perfluoroheptene to convert heat energy to mechanical work by using a trans-critical power cycle. The ORC system is operating as a trans-critical cycle when the working fluid receives heat at a pressure higher than the critical pressure of the working fluid. In a trans-critical cycle, the working fluid does not remain at a pressure higher than its critical pressure throughout the entire cycle. This process comprises the following steps: (a) compressing a liquid working fluid to a pressure above the working fluid's critical pressure; (b) heating the compressed working fluid from step (a) using heat supplied by the heat source; (c) expanding the heated working fluid from step (b) to lower the pressure of the working fluid below its critical pressure to generate mechanical work; (d) cooling the expanded working fluid from step (c) to form a cooled liquid working fluid; and (e) cycling the cooled liquid working fluid from step (d) to step (a) to repeat the cycle.

In the first step of the trans-critical power cycle system, described above, the working fluid in liquid phase is compressed to above its critical pressure. In a second step, said working fluid is passed through a heat exchanger to be heated to a higher temperature before the fluid enters the expander wherein the heat exchanger is in thermal communication with said heat source. The heat exchanger receives heat energy from the heat source by any known means of thermal transfer. The ORC system working fluid circulates through the heat supply heat exchanger where the fluid gains heat.

In the next step, at least a portion of the heated working fluid is removed from the heat exchanger and is routed to the expander where fluid expansion results in conversion of at least portion of the heat energy content of the working fluid into mechanical energy, such as shaft energy. The pressure of the working fluid is reduced to below the critical pressure of the working fluid, thereby producing vapor phase working fluid.

In the next step, the working fluid is passed from the expander to a condenser, wherein the vapor phase working fluid is condensed to produce liquid phase working fluid. The above steps form a loop system and can be repeated many times.

Additionally, for a trans-critical power cycle, there are several different modes of operation. In one mode of operation, in the first step of a trans-critical power cycle, the working fluid is compressed above the critical pressure of the working fluid substantially isentropically. In the next step, the working fluid is heated under a substantially constant pressure (isobaric) condition to above its critical temperature. In the next step, the working fluid is expanded substantially isentropically at a temperature that maintains the working fluid in the vapor phase. At the end of the expansion the working fluid is a superheated vapor at a temperature below its critical temperature. In the last step of this cycle, the working fluid is cooled and condensed while heat is rejected to a cooling medium. During this step the working fluid is condensed to a liquid. The working fluid could be subcooled at the end of this cooling step.

In another mode of operation of a trans-critical ORC power cycle, in the first step, the working fluid is compressed above the critical pressure of the working fluid, substantially isentropically. In the next step the working fluid is then heated under a substantially constant pressure condition to above its critical temperature, but only to such an extent that in the next step, when the working fluid is expanded substantially isentropically, and its temperature is reduced, the working fluid is sufficiently close to being a saturated vapor that partial condensation or misting of the working fluid may occur. At the end of this step, however, the working fluid is still a slightly superheated vapor. In the last step, the working fluid is cooled and condensed while heat is rejected to a cooling medium. During this step the working fluid is condensed to a liquid. The working fluid could be subcooled at the end of this cooling/condensing step.

In another mode of operation of a trans-critical ORC power cycle, in the first step, the working fluid is compressed above the critical pressure of the working fluid, substantially isentropically. In the next step, the working fluid is heated under a substantially constant pressure condition to a temperature either below or only slightly above its critical temperature. At this stage, the working fluid temperature is such that when the working fluid is expanded substantially isentropically in the next step, the working fluid is partially condensed. In the last step, the working fluid is cooled and fully condensed and heat is rejected to a cooling medium. The working fluid may be subcooled at the end of this step.

While the above embodiments for a trans-critical ORC cycle show substantially isentropic expansions and compressions, and substantially isobaric heating or cooling, other cycles wherein such isentropic or isobaric conditions are not maintained but the cycle is nevertheless accomplished, is within the scope of the present invention.

Typically for a trans-critical ORC, the temperature to which the working fluid is heated using heat from the heat source is in the range of from about 195° C. to about 300° C., preferably from about 200° C. to about 250° C., more preferably from about 200° C. to 225° C. Typical expander inlet pressures for trans-critical cycles are within the range of from about the critical pressure, 1.79 MPa, to about 7 MPa, preferably from about the critical pressure to about 5 MPa, and more preferably from about the critical pressure to about 3 MPa. Typical expander outlet pressures for trans-critical cycles are comparable to those for subcritical cycles.

Super-Critical Rankine Cycle

Another embodiment of the present invention relates to a process of using a working fluid comprising perfluoroheptene to convert heat energy to mechanical work by using a super-critical power cycle. An ORC system is operating as a super-critical cycle when the working fluid used in the cycle is at pressures higher than its critical pressure throughout the cycle. The working fluid of a super-critical ORC does not pass through a distinct vapor-liquid two-phase transition as in a sub-critical or trans-critical ORC. This method comprises the following steps: (a) compressing a working fluid from a pressure above its critical pressure to a higher pressure; (b) heating the compressed working fluid from step (a) using heat supplied by the heat source; (c) expanding the heated working fluid from step (b) to lower the pressure of the working fluid to a pressure above its critical pressure and generate mechanical work; (d) cooling the expanded working fluid from step (c) to form a cooled working fluid above its critical pressure; and (e) cycling the cooled working fluid from step (d) to step (a) for compression.

Typically for super-critical cycles, the temperature to which the working fluid is heated using heat from the heat source is in the range of from about 190° C. to about 300° C., preferably from about 200° C. to about 250° C., more preferably from about 200° C. to 225° C. The pressure of the working fluid in the expander is reduced from the expander inlet pressure to the expander outlet pressure. Typical expander inlet pressures for super-critical cycles are within the range of from about 2 MPa to about 7 MPa, preferably from about 2 MPa to about 5 MPa, and more preferably from about 3 MPa to about 4 MPa. Typical expander outlet pressures for super-critical cycles are within about 0.01 MPa above the critical pressure.

Low Quality Heat Sources

The novel working fluids of the present invention may be used in ORC systems to generate mechanical work from heat extracted or received from relatively low temperature heat sources such as low pressure steam, industrial waste heat, solar energy, geothermal hot water, low-pressure geothermal steam (primary or secondary arrangements), or distributed to power generation equipment utilizing fuel cells or prime movers such as turbines, micro-turbines, or internal combustion engines. One source of low-pressure steam could be the system known as a binary geothermal Rankine cycle. Large quantities of low-pressure steam can be found in numerous locations, such as in fossil fuel powered electrical generating power plants.

Other sources of heat include waste heat recovered from gases exhausted from mobile internal combustion engines (e.g. truck or rail or marine diesel engines), waste heat from exhaust gases from stationary internal combustion engines (e.g. stationary diesel engine power generators), waste heat from fuel cells, heat available at combined heating, cooling and power or district heating and cooling plants, waste heat from biomass fueled engines, heat from natural gas or methane gas burners or methane-fired boilers or methane fuel cells (e.g. at distributed power generation facilities) operated with methane from various sources including biogas, landfill gas and coal-bed methane, heat from combustion of bark and lignin at paper/pulp mills, heat from incinerators, heat from low pressure steam at conventional steam power plants (to drive "bottoming" Rankine cycles), and geothermal heat.

In one embodiment of the Rankine cycles of this invention, geothermal heat is supplied to the working fluid circulating above ground (e.g. binary cycle geothermal power plants). In another embodiment of the Rankine cycles of this invention, a novel working fluid composition of this invention is used both as the Rankine cycle working fluid and as a geothermal heat carrier circulating underground in deep wells with the flow largely or exclusively driven by temperature-induced fluid density variations, known as "the thermosyphon effect" (e.g. see Davis, A. P. and E. E. Michaelides: "Geothermal power production from abandoned oil wells", Energy, 34 (2009) 866-872; Matthews, H. B. U.S. Pat. No. 4,142,108-Feb. 27, 1979)

Other sources of heat include solar heat from solar panel arrays including parabolic solar panel arrays, solar heat from concentrated solar power plants, heat removed from photovoltaic (PV) solar system to cool the PV system to maintain a high PV system efficiency.

In other embodiments, the present invention also uses other types of ORC system, for example, small scale (e.g. 1-500 kW, preferably 5-250 kW) Rankine cycle system using micro-turbines or small size positive displacement expanders (e.g. Tahir, Yamada and Hoshino: "Efficiency of compact organic Rankine cycle system with rotary-vane-type expander for low-temperature waste heat recovery", Intl J. of Civil and Environ. Eng 2:1 2010), combined, multistage, and cascade Rankine Cycles, and Rankine Cycle system with recuperators to recover heat from the vapor exiting the expander.

Other sources of heat include at least one operation associated with at least one industry selected from the group consisting of: marine shipping, oil refineries, petrochemical plants, oil and gas pipelines, chemical industry, commercial buildings, hotels, shopping malls, supermarkets, bakeries, food industries, restaurants, paint curing ovens, furniture making, plastics molders, cement kilns, lumber kilns, calcining operations, steel industry, glass industry, foundries, smelting, air-conditioning, refrigeration, and central heating.

EXAMPLE

The concepts described herein will be further described in the following examples, which do not limit the scope of the invention described in the claims.

Example 1

The projected cycle efficiency of an ORC system utilizing HFC-245fa as a working fluid was compared to the projected cycle efficiency of the ORC system utilizing a mixture of 2-perfluoroheptene and 3-perfluoroheptene as a working fluid. It was assumed that the maximum feasible working pressure of the ORC system was about 3 MPa and that a heat source was available that would allow the temperature of either working fluid at the expander inlet to be maintained at 160° C.

Shown in Table 1 is a comparative table for HFC-245fa and a mixture containing 20% 2-perfluoroheptene and 80% 3-perfluoroheptene (mixture purity: 99.20%) utilized as the working fluid in a subcritical cycle. The operating parameters of the ORC system using HFC-245fa as the working fluid are shown under the column labeled "HFC-245fa". The operating parameters of the ORC system using the 2-perfluoroheptene/3-perfluoroheptene mixture as the working fluid are shown under the column labeled "2-Perfluoroheptene/3-Perfluoroheptene". Experimentally determined vapor pressures of the 2-perfluoroheptene/3-perfluoroheptene mixture are shown below in Table 1A.

TABLE 1

| Parameters | Units | HFC-245fa | 2-Perfluoroheptene/ 3-Perfluoroheptene |
|---|---|---|---|
| Mean Molecular Weight | g/mol | 134.05 | 350.0546 |
| GWP | — | 858 | Lower than about 4 |
| NBP | °C. | 15.1 | 72.5 |
| Tcr | °C. | 154 | 198 |
| Pcr | MPa | 3.65 | 1.54 |
| Evaporator Temp | °C. | 145 | 160 |
| Evaporator Superheat | °K | 15 | 0 |
| Condenser Temperature | °C. | 85 | 85 |
| Condenser Sub-cooling | °K | 5 | 5 |
| Expander Efficiency | 0.75 | 0.75 | |

TABLE 1-continued

| Parameters | Units | HFC-245fa | 2-Perfluoroheptene/ 3-Perfluoroheptene |
|---|---|---|---|
| Pump Efficiency | 0.55 | 0.55 | |
| Expander Inlet Temperature | °C. | 160 | 160 |
| Evaporator Pressure | MPa | 3.1 | 0.785 |
| Condenser Pressure | MPa | 0.893 | 0.135 |
| Expansion Ratio | 3.473 | 5.827 | |
| Expander Exit Temperature | °C. | 116.3 | 138.2 |
| Cycle Effic | % | 7.023 | 7.151 |
| Cycle Effic vs HFC-245fa | % | +1.8% | |

TABLE 1A

| Temp (°C.) | Vapor Pressure (psia) |
|---|---|
| −9.926 | 0.3421 |
| −0.062 | 0.6348 |
| 9.885 | 1.1202 |
| 19.904 | 1.8863 |
| 20.000 | 1.8905 |
| 20.015 | 1.8922 |
| 29.992 | 3.0673 |
| 45.036 | 5.8476 |
| 60.045 | 10.3122 |
| 75.068 | 17.1183 |
| 90.150 | 27.1188 |
| 105.184 | 41.0299 |
| 120.217 | 59.9598 |
| 130.256 | 75.9433 |

The above example assumes that heat is available to maintain the expander inlet at 160° C. The evaporating temperature with HFC-245fa was limited to 145° C. to ensure that the pressure within the evaporator remains below the maximum permitted design working pressure for commonly available commercial equipment components (e.g. heat exchangers) for ORC systems.

The evaporating pressure with the 2-perfluoroheptene/3-perfluoroheptene mixture remains sufficiently lower than that of HFC-245fa so that neither the maximum working pressure for commonly available commercial equipment for ORC systems, nor the pressure threshold for additional safety measures required in some jurisdictions for the ORC system designed for HFC-245fa are exceeded. Furthermore, the perfluoroheptene mixture is expected to exhibit acceptable chemical stability within these working parameters.

The above example shows that using a mixture of 2-perfluoroheptene/3-perfluoroheptene may achieve a 1.8% higher cycle efficiency versus HFC-245fa when used in an ORC system designed for use with HFC-245fa as the working fluid while reducing the working fluid GWP by more than 99.5%. The working fluid containing HFC-245fa in an existing ORC system may be replaced by evacuating the working fluid, flushing the ORC system with a lubricant or working fluid comprising a perfluoroheptene selected from the group consisting of 2-perfluoroheptene, 3-perfluoroheptene, and combinations thereof, and charging the ORC system with a working fluid having a perfluoroheptene selected from the group consisting of 2-perfluoroheptene, 3-perfluoroheptene, and combinations thereof.

Example 2

Shown in Table 2 is a comparative table for a mixture containing 20% 2-perfluoroheptene and 80% 3-perfluoroheptene (mixture purity: 99.20%) utilized as the working fluid in a subcritical cycle and as the working fluid in a transcritical cycle, where the expander inlet temperature is maintained at 220° C.

TABLE 2

| Parameters | Units | Subcritical Cycle | Transcritical Cycle |
|---|---|---|---|
| Evaporator Temp | °C. | 160 | n/a |
| Evaporator Superheat | °K | 60 | n/a |
| Condenser Temperature | °C. | 85 | 85 |
| Condenser Sub-cooling | °K | 5 | 5 |
| Expander Efficiency | | 0.75 | 0.75 |
| Pump Efficiency | | 0.55 | 0.55 |
| Expander Inlet Pressure | MPa | 0.785 | 3 |
| Expander Inlet Temperature | °C. | 220 | 220 |
| Evaporator Pressure | MPa | 0.785 | n/a |
| Condenser Pressure | MPa | 0.135 | 0.135 |
| Expansion Ratio | | 5.8 | 22.3 |
| Expander Exit Temperature | °C. | 200.6 | 158.8 |
| Cycle Effie | % | 6.158 | 8.102 |
| Cycle Thermal Effic vs Subcritical Cycle | % | — | +31.6% |
| Cycle CAP | kJ/m$^3$ | 160.255 | 187.582 |
| Cycle CAP vs Subcritical Cycle | % | — | +17.1% |

The above table indicates that when heat is available at a temperature that allows the expander inlet temperature to be maintained at 220° C., transcritical operation enables a cycle thermal efficiency and a cycle volumetric capacity higher than those of subcritical operation by 31.6% and 17.1%, respectively.

While the present invention has been particularly shown and described in terms of the preferred embodiment thereof, it is understood by one skilled in the art that various changes in detail may be effected therein without departing from the spirit and scope of the invention as set forth in the claims.

What is claimed is:

1. A process of converting heat to mechanical work in a trans-critical Organic Rankine cycle, comprising the steps of:

(a) compressing a liquid working fluid above said working fluid's critical pressure to form a compressed working fluid;

(b) heating the compressed working fluid using heat supplied by a heat source to form a heated working fluid;

(c) expanding the heated working fluid to generate mechanical work and lowering the pressure of the working fluid below its critical pressure;

(d) cooling the working fluid from step (c) to form a cooled liquid working fluid; and (e) cycling the cooled liquid working fluid from step (d) to step (a) to repeat the cycle;

wherein said working fluid consists of a mixture of 2-perfluoroheptene and 3-perfluoroheptene.

2. The process of claim 1, wherein said working fluid consists of a mixture of 20% 2-perfluoroheptene and 80% 3-perfluoroheptene.

3. A method to replace the working fluid of an Organic Rankine Power Cycle System charged with a working fluid containing HFC-245fa, comprising:

(a) evacuating the working fluid containing HFC-245fa from said Organic Rankine Cycle System; and (b) charging said Organic Rankine Cycle system with a working fluid consisting of a mixture of 2-perfluoroheptene and 3-perfluoroheptene.

4. The method of claim 3, wherein said working fluid consists of a mixture of 20% 2-perfluoroheptene and 80% 3-perfluoroheptene.

* * * * *